United States Patent [19]

Potts

[11] 4,049,307

[45] Sept. 20, 1977

[54] EXTRACTOR DEVICE

[76] Inventor: Walter C. Potts, 4525 A St., Lincoln, Nebr. 68510

[21] Appl. No.: 682,115

[22] Filed: Apr. 30, 1976

[51] Int. Cl.[2] ..... B66C 1/44

[52] U.S. Cl. ..... 294/99 R; 29/268; 81/420; 294/1 R

[58] Field of Search ..... 294/1 R, 3, 16, 28, 294/33, 86 R, 20, 99 R, 99 S, 86.1, 100, 113, 117, 118; 29/268; 81/3.05, 3 R, 3.8, 5.1 B, 5.1 R, 43, 420

[56] References Cited

U.S. PATENT DOCUMENTS

| | | | |
|---|---|---|---|
| 1,411,316 | 4/1922 | Vestal | 294/99 S |
| 1,459,612 | 6/1923 | Buker | 81/43 X |
| 1,910,937 | 5/1933 | Thane | 294/86 R X |
| 2,184,074 | 12/1939 | Gent | 294/20 X |
| 2,584,547 | 2/1952 | Cahn | 81/43 X |
| 2,648,126 | 8/1953 | Flickinger | 29/268 |

FOREIGN PATENT DOCUMENTS

| | | | |
|---|---|---|---|
| 1,286,457 | 1/1969 | Germany | 294/86 R |

OTHER PUBLICATIONS

"Plier Type Wire Guiding Tool", R. A. Cuneo, Western Electric Tech. Digest No. 33, Jan., 1974, pp. 27–28.

*Primary Examiner*—Johnny D. Cherry

[57] ABSTRACT

An extractor device for the removal of an elongated element from a confined opening such as a broken pencil from a pencil well of a desk includes an extractor gripping element and a modified plier's member which detachably secures to the extractor gripping element. The extractor gripping element includes a cylindrically shaped member having a longitudinally placed bore extending therethrough. The cylindrically shaped element is inserted into the pencil well such that the pencil is engaged into the bore. The plier's member engages the cylindrically shaped member, wherein the user exerts an upwardly force to lift the pencil and cylindrically shaped element from the pencil well.

9 Claims, 3 Drawing Figures

EXTRACTOR DEVICE

SUMMARY OF THE INVENTION

My present invention relates to a unique and novel extractor device used for the removal of an elongated element from a confined opening such as a broken pencil from a pencil well of a desk or a crayon from a drain pipe of a sink.

A number of U.S. patents have employed variously designed extractor devices; however, these U.S. patents are nonapplicable to the extractor device of the present instant application. U.S. Pat. Nos. 290,255; 976,325; and 2,489,285 employ shell extractor devices for removing exploded shells from a breech loading guns. These devices are nonapplicable to the removal of a pencil from a pencil well.

An object of my present invention is to provide a device which can be used readily to extract a broken pencil from a pencil well, wherein both ends of the broken pencil are contained within the pencil well and not exposed above the upper surface of the desk.

A still further object of may pesent invention is to provide an extractor device universally adaptable to extract any elongated element from a confined opening.

Briefly, my present invention comprises an extractor gripping element and a modified plier's member which detachably secures to the extractor gripping element. The extractor gripping element includes a cylindrically shaped member having a longitudinally placed bore extending therethrough. The cylindrically shaped element is inserted into the pencil well such that the pencil is engaged into the bore. The plier's member engages the cylindrically shaped member, wherein the user exerts an upwardly force to lift the pencil and cylindrically shaped element from the pencil well.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
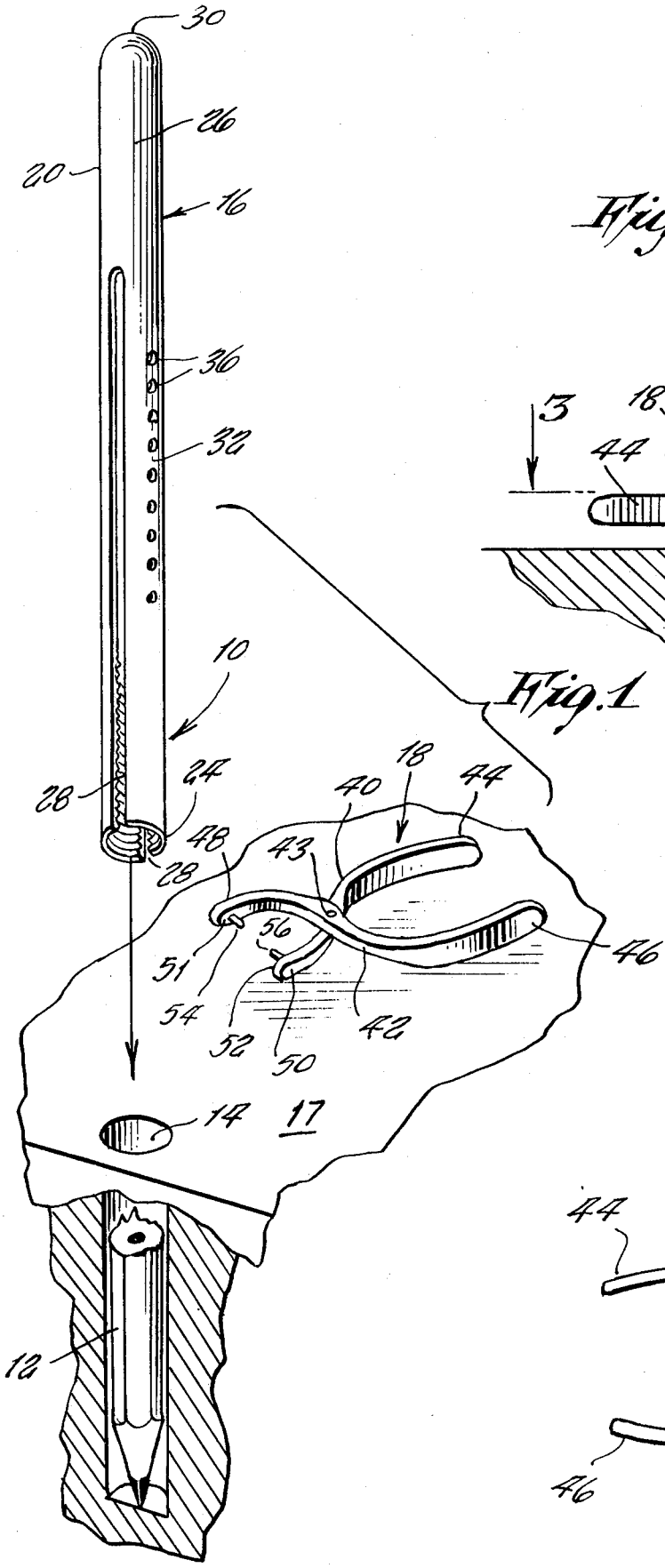
FIG. 1 illustrates a front partially cutaway of an extractor device used to extract a pencil from a pencil well.
Figure 2:
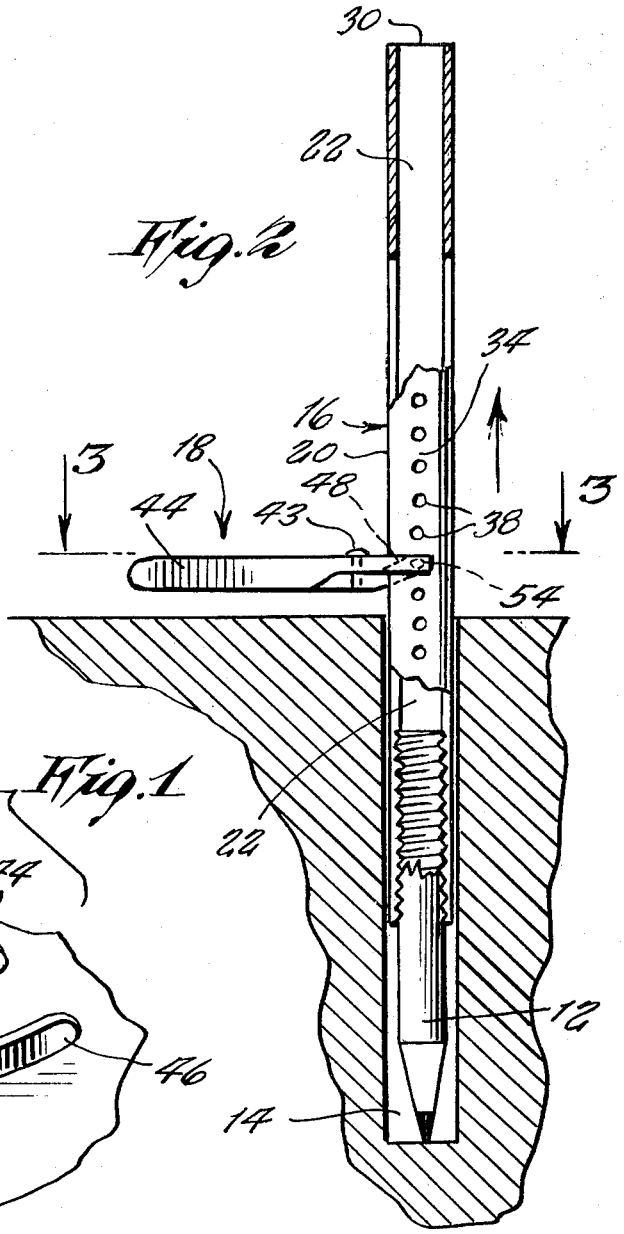
FIG. 2 illustrates a side cross-sectional view of the extractor device removing the pencil from the pencil well.

Turning now descriptively to the drawings, in which similar reference characters denote similar elements throughout the several views, FIGS. 1, 2 show an extractor device 10 being used to extract a broken pencil 12 from a pencil well 14 contained in a desk top 17 of a school desk. The extractor device 10 can be readily employed to extract any elongated element from a confined opening such as a crayon from a drainage pipe of a sink. The extractor device 10 comprises an extractor gripping element 16 which engages the pencil 14 and a modified plier's member 18 for detachably engaging the extractor gripping element 16. The extractor gripping element 16 comprises an elongated cylindrically shaped element 20 having a longitudinally placed bore 22 therethrough. The bore 22 is internally threaded at a first end 24 of the cylindriclly shaped element 20. The sidewall 26 of the cylindrically shaped element 20 has a pair of longitudinally placed slot apertures 28 therethrough, wherein the apertures 28 extend from the first end 24 of the cylindrically shaped element 20 to just past a midpoint of the cylindrically shaped element 20. The bore 22 is tapered slightly from the first end 24 to a second end 30 of the cylindrically shaped element 20, wherein the diameter of the bore 22 is greater at the first end 24 than the second end 30 of the cylindrically shaped element 20. The sidewall 26 of the cylindrically shaped element 20 has two rows 32, 34 of longitudinally aligned apertures 36, 38 therein, wherein each row 32, 34 extends from the first end 24 about half the length of the cylindrically shaped element 20. The two rows 32, 34 are positioned on opposite sides of the sidewall 26 from each other, wherein apertures 36, 38 extend through the sidewall to communicate with the bore 22.

Figure 3:
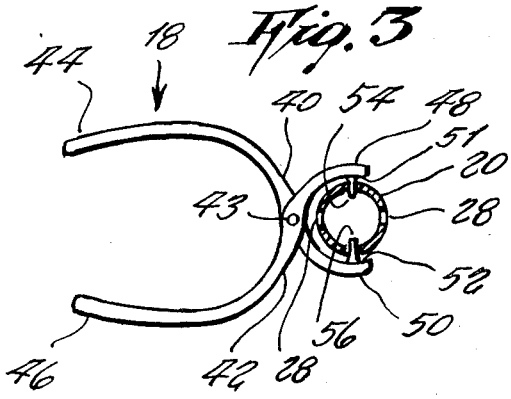
FIG. 3 illustrates a top planar view of a plier's member of the extractor device.

FIGS. 2, 3 show the modified plier's member 18 which detachably engages the gripping element 16. The member 18 comprises two arms 40, 42 which are pivotally joined together at their centers by a pin 43 extending transversely through each arm 40, 42. Each arm 40, 42 has a handle end 44, 46 and a jaw end 48, 50. The handle ends 44, 46 have a slightly curved configuration as well as the jaw ends 48, 50. The inner faces 51, 52 of the jaw ends 48, 50 are planar. One peg member 54, 56 is affixed perpendicularly onto the inner planar faces 50, 52 of each jaw end 48, 50 of each arm 40, 42.

In use, the first end 24 of the element 20 is inserted into the pencil well 14. The user holds the element 20 in a vertical alignment and strikes the second end 30 of element 20 with a heavy object such as a hammer which causes element 20 to be driven downwardly into the well 14, wherein the end of the broken pencil 12 inserts into the bore 22 of the element 20. The threaded surface of the bore 22 fricitionally engages the pencil 12. The user spreads the jaw ends 48, 50 of the member 18. The peg members 54, 56 are inserted into the apertures 36, 38 of element 20. The jaw ends 48, 50 are closed by compressing the handle ends 44, 46 together. The user holds the handle ends 44, 46 together and pulls upwardly causing the gripping element 16 and pencil 12 to move upwardly and out of the pencil well 14.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. An extractor device adapted to remove an elongated element from a confined opening, which comprises:

a. an elongated housing having first and second ends, a wall, and a longitudinally placed bore therethrough, said well of said housing having a pair of longitudinally aligned rows of apertures therein, said elongated element adapted to be received into said bore of said housing;

b. a plier-like member including a pair of arms pivotally joined together at their centers, each said arm having a jaw and a handle end; and c. a pin member included on an inner face of each said jaw end, an aperture of one of said rows for receiving one of said pin members, a corresponding aligned aperture of the other of said rows for receiving the other of said pin members.

2. An extractor device according to claim 1, wherein said housing is provided with a pair of longitudinally placed slotted openings, each said slotted opening extending from said first end for a portion of said housing.

3. An exractor device according to claim 2, wherein two said slotted openings are diametrically opposed.

4. An extractor device according to claim 1, wherein said bore of said elongated housing is threaded.

5. An extractor device according to claim 1, wherein said housing is cylindrically shaped.

6. An extractor device according to claim 1, wherein each said handle end of each said arm is relatively curved.

7. An extractor device according to claim 1, wherein each said jaw end is relatively curved.

8. An extractor device according to claim 1, wherein said bore of said elongated housing is cylindrically shaped and tapered with a greater diameter at said first end.

9. An extractor device according to claim 1, wherein two said rows are diametrically opposed.

* * * * *